US011292262B2

(12) United States Patent
Schalk et al.

(10) Patent No.: US 11,292,262 B2
(45) Date of Patent: Apr. 5, 2022

(54) FLUID SUPPLIES

(71) Applicant: HEWLETT-PACKARD DEVELOPMENT COMPANY, L.P., Spring, TX (US)

(72) Inventors: Wesley R. Schalk, Vancouver, WA (US); Judson M. Leiser, Corvallis, OR (US); Ronald J. Ender, Corvallis, OR (US); Paul Mark Haines, Corvallis, OR (US); Roger J. Kolodziej, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,318

(22) PCT Filed: Jul. 13, 2018

(86) PCT No.: PCT/US2018/041970
§ 371 (c)(1),
(2) Date: Sep. 29, 2019

(87) PCT Pub. No.: WO2020/013844
PCT Pub. Date: Jan. 16, 2020

(65) Prior Publication Data

US 2021/0323313 A1 Oct. 21, 2021

(51) Int. Cl.
*B41J 2/175* (2006.01)
*B41J 29/02* (2006.01)

(52) U.S. Cl.
CPC ..... *B41J 2/17553* (2013.01); *B41J 2/17506* (2013.01); *B41J 2/17513* (2013.01);
(Continued)

(58) Field of Classification Search
CPC .... B41J 2/175; B41J 2/17506; B41J 2/17509; B41J 2/17513; B41J 2/17526;
(Continued)

(56) References Cited

U.S. PATENT DOCUMENTS 5,396,316 A 3/1995 Smtih
5,734,401 A 3/1998 Clark et al.
(Continued)

FOREIGN PATENT DOCUMENTS

CN 101712238 5/2010
CN 102381044 3/2012
(Continued)

OTHER PUBLICATIONS

How to Modify Printer Ink, Canon.

*Primary Examiner* — Anh T Vo
(74) *Attorney, Agent, or Firm* — HP Inc. Patent Department

(57) ABSTRACT

A printing device interface to receive a fluid supply may include a fluid dock arranged on an external surface of a housing of the printing device, the fluid dock further arranged to receive a mechanical interface of a fluid supply wherein the arrangement of the fluid dock on the external surface of the housing enables use of a center of mass and weight of the fluid supply to maintain a mechanical, fluidic, and electrical connection with the fluid supply.

20 Claims, 12 Drawing Sheets

(52) U.S. Cl.
CPC ..... *B41J 2/17566* (2013.01); *B41J 29/02* (2013.01); *B41J 2002/17576* (2013.01)

(58) Field of Classification Search
CPC .. B41J 2/17546; B41J 2/1755; B41J 2/17553; B41J 2/17566; B41J 29/02
See application file for complete search history.

(56) References Cited

U.S. PATENT DOCUMENTS

| | | | | |
|---|---|---|---|---|
| 5,956,057 | A | 9/1999 | Childers et al. | |
| 6,315,402 | B1 * | 11/2001 | Kawase | B41J 2/17513 347/85 |
| 7,008,051 | B2 | 3/2006 | Akermalm | |
| 8,070,274 | B2 | 12/2011 | Steinmeiz et al. | |
| 2001/0019346 | A1 | 9/2001 | Pawlowski, Jr. et al. | |
| 2002/0149646 | A1 * | 10/2002 | Pawlowski, Jr. | B41J 2/1752 347/50 |
| 2003/0076390 | A1 * | 4/2003 | Sturgeon | B41J 2/1752 347/86 |
| 2004/0113971 | A1 * | 6/2004 | Nakajima | B41J 11/00214 347/29 |
| 2008/0106575 | A1 | 5/2008 | Shimizu et al. | |
| 2008/0252701 | A1 | 10/2008 | Matsumoto et al. | |
| 2011/0205284 | A1 * | 8/2011 | Yoshino | B41J 2/17526 347/20 |
| 2015/0109388 | A1 | 4/2015 | Okuno et al. | |
| 2017/0100939 | A1 | 4/2017 | Satoshi | |

FOREIGN PATENT DOCUMENTS

| | | | |
|---|---|---|---|
| EP | 0838339 | B1 | 8/2002 |
| JP | 2012254600 | A | 12/2012 |
| JP | 5998466 | B2 | 9/2016 |
| JP | 6182828 | | 8/2017 |
| RU | 2472625 | C2 | 1/2013 |
| RU | 2490139 | C2 | 8/2013 |
| WO | WO2006129882 | A1 | 12/2006 |
| WO | WO2015059928 | A1 | 4/2015 |

* cited by examiner

FLUID SUPPLIES

BACKGROUND

Some printing devices operate to dispense a liquid onto a surface of a substrate. In some examples, these printing devices may include two-dimensional (2D) and three-dimensional (3D) printing devices. In the context of a 2D printing device, a liquid such as an ink may be deposited onto the surface of the substrate. In the context of a 3D printing device, an additive manufacturing liquid may be dispensed onto a surface of a build platform in order to build up a 3D object during an additive manufacturing process. In these examples, the print liquid is supplied to such printing devices from a reservoir or other supply. The print liquid reservoir holds a volume of print liquid that is passed to a liquid deposition device and ultimately deposited on a surface.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
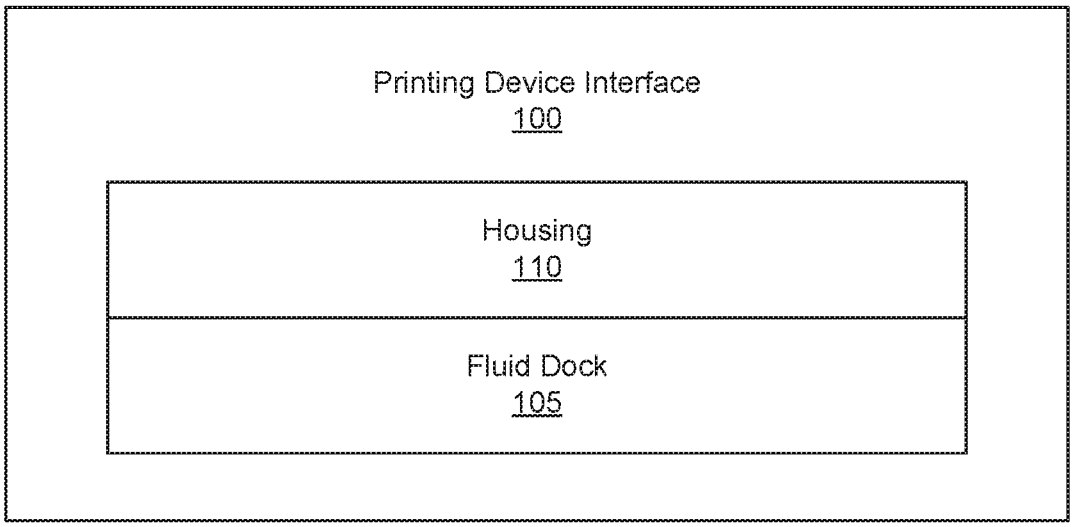
FIG. 1 is a block diagram of a printing device interface according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In order to handle the large volume of prints provided by multi-user businesses or institutional environments, some printing devices include relatively large, replaceable fluid supplies of printing fluid. These fluid supplies are able to produce tens of thousands of pages before the fluid supply is to be replaced. Consequently, these fluid supplies may maintain relatively large volumes of printing fluid; as much as 5 or more liters per color or type of fluid used by the printing device. Other type of printing devices also may include internal reservoirs that may maintain a relatively large amount of printing fluid. These internal reservoirs may be "topped-off" or resupplied by a fluid supply being fluidically coupled thereto.

These printing devices may also, in some examples, implement continuous fluid supply systems (CFSS), sometimes called continuous ink supply systems (CISS), that may hold volumes greater than or equal to their fluid supply-based equivalents. As many as 3 or more liters of printing fluid may be implemented to completely refill an internal reservoir. However, this refill process can be time-consuming and cumbersome.

This present specification, in some examples, describe a method for resupplying printing devices using CFSS. The method may include introducing a printing supply containing a printing fluid that "docks" or "hangs" onto the printing device from a dock in a self-supporting manner. This enables a user to refill relatively large volumes of internal reservoirs in a printing device with printing supplies containing a printing fluid, unattended by the user. This may relatively more efficiently provide for the resupply of printing devices than possible with other types of printing devices.

The present specification describes, in an example, a printing device interface to receive a fluid supply that includes a fluid dock arranged on an external surface of a housing of the printing device, the fluid dock further arranged to receive a mechanical interface of a fluid supply; wherein the arrangement of the fluid dock on the external surface of the housing enables use of a center of mass and weight of the fluid supply to maintain a mechanical, fluidic, and electrical connection with the fluid supply.

The present specification, in an example, also describes a continuous fluid supply system that includes a printing device that includes an internal reservoir to maintain an amount of printing fluid and a fluid supply dock external to a housing of the printing device, the fluid supply dock to receive and interface with a fluid supply unit, wherein an arrangement of the fluid supply dock external to the housing enables a center of mass and weight of the fluid supply to be used to maintain a mechanical, fluidic, and electrical connection between the fluid supply dock and the fluid supply.

The present specification further describes a fluid supply interface of a fluid supply dock that includes an alignment rail to mechanically couple a fluid supply unit to a fluid supply dock external to a housing of a printing device; a mechanical aperture to interface with a mechanical key of the fluid supply unit; a needle to fluidically couple the fluid supply unit to an internal reservoir of the printing device; and a controller to enable an electrical coupling between the printing device and a memory device; wherein a mechanical coupling using the alignment rail is to occur prior to a fluidic coupling between the septum and the fluid supply unit.

As used in the present specification and in the appended claims, the term "fluid" is meant to be understood as any substance that may be received by a printing device in order to form a two-dimensional (2D) or three-dimensional (3D). Examples of fluids may include, without limitations, an ink of any type or color or an additive manufacturing fabrication agent. Still further, as used in the present specification and in the appended claims, the term "fabrication agent" refers to any number of agents that are deposited and includes for example a fusing agent, an inhibitor agent, a binding agent, a coloring agent, and/or a material delivery agent. A material delivery agent refers to a liquid carrier that includes suspended particles of material used in the additive manufacturing process.

Turning now to the figures, FIG. 1 is a block diagram of a printing device interface (100) according to an example of the principles described herein. The printing device interface (100) may include a fluid dock (105) exterior to a surface of a housing (110) of a printing device. The fluid dock (105) may be arranged to receive a mechanical interface of a fluid supply unit as is described herein.

The printing device interface (100), in an example, may be used for a refill process that causes a printing fluid to be passed from the interfaced fluid supply unit to an internal reservoir of the printing device. In any example presented herein, the volumetric capacity of the internal reservoir of the printing device may exceed the volumetric capacity of the fluid supply unit. In any example presented herein, the volumetric capacity of the internal reservoir may be smaller than the volumetric capacity of the fluid supply unit.

In any example presented herein, the fluid dock (105) of the printing device may be included with another fluid dock (105). In this example, the plurality of fluid docks (105) may be arranged side by side so as to facilitate the interfacing of a fluid supply unit at each of the plurality of fluid docks (105). As a consequence, each of the fluid supply units may provide a distinct type and/or color of printing fluid via the interface. Each of these distinct types and/or colors of printing fluid may be provided to the printing device at individual amounts and at individual rates of transfer. In an example, the transfer of the distinct types and/or colors of printing fluid may be provided to individual internal reservoirs maintained within the printing device to hold that specific type and/or color of printing fluid.

In any of the examples presented herein, the refill process described herein may occur during a printing operation of the printing device simultaneously being conducted. In this example, an internal reservoir of the printing device may supply a printing fluid to a printhead or other type of fluid dispenser while receiving an amount of fluid via the interface from the plurality of fluid supply units.

Each fluid dock (105) may allow each of the fluid supply units to hang from an exterior of the printing device. As described in more detail herein, the supply docks may hang from a surface exterior to any housing of the printing device. In some examples, where the fluid dock (105) is not interfaced with a fluid supply unit, a cover may be placed over the fluid dock (105) or fluid docks (105). Allowing the fluid supply units to hang from the fluid dock (105) allows for a fluid supply unit to be interfaced with the fluid supply dock and hang from the printing device as the herein-described refill process is being conducted. As the fluid supply units are hanging from the fluid docks (105), the refill process may continue without user interaction and unattended by a user. This may allow a user to address other printing devices or other functionalities of the printing device while the refill process is conducted.

In any example presented herein, the hanging of the fluid supply units from off of the fluid docks (105) reduces the costs associated with manufacturing and operating the printing device. Because the fluid dock (105) itself interfaces with the fluid supply unit, latching mechanisms outside of the printing device are not used. Additionally, because the fluid supply units hang from the fluid dock (105), a dedicated portion of the housing is not used to cover the fluid supply units during a fluid refill or transfer process. Additionally, the fluid dock (105) provides for a relatively reliable and robust interface that includes a low-profile interface between the printing device and the fluid supply units. This low profile may maintain a center of mass of the fluid supply units close to the fluid dock (105) so as to allow the weight of the fluid within the fluid supply units to help maintain the coupling of the fluid supply units to the fluid dock (105). The weight and form of the fluid supply units as they interface with the fluid dock (105) may maintain a mechanical, fluidic, and/or electrical connection between the fluid dock (105) and the fluid supply unit. In an example, the center of mass of the fluid supply are above the fluid dock (105) such that a fluid within the fluid supply unit is transferred from the fluid supply through the fluid dock (105) via gravity. In an example, the center of mass of the fluid supply are below the fluid dock (105) such that a fluid within the fluid supply unit is transferred from the fluid supply through the fluid dock (105) via a pump downstream of the fluid dock (105).

The interfacing of the fluid supply unit with the fluid dock (105) forms a fluidic channel between a reservoir within the fluid supply unit and an internal reservoir in the printing device. In an example, the fluidic channel is created after verification via an electrical handshake that the fluid to be transferred from the fluid supply unit to the fluid dock (105) is allowed based on, for example, a confirmation that the fluid is an authentic fluid.

In an example, a controller of the printing device may detect the presence of a fluid supply unit at the fluid dock (105) and/or as it is engaged with the fluid dock (105). In an example, a number of electrical connections may be made between a number of electrical contact pads formed on or at the fluid dock (105) and a number of electrical leads of a memory device formed on the fluid supply. Upon detection between the contact pads and leads, the controller may send and/or receive data to and/or from the memory device of the fluid supply unit. The data may include any data describing characteristics of the printing device, characteristics of the fluid supply unit, and/or characteristics of the fluid maintained within the fluid supply unit. Specific examples of data may include chemical characteristics of the fluid, liquid volume within the fluid supply unit, product IDs of the fluid supply unit and/or fluid, digital signatures, base keys for calculating session keys for authenticated data communications between the printing device and fluid supply unit, and color transform data, among other types of data. In any example presented herein, the printing device may, via execution of computer readable program code, send and/or receive this data automatically upon detection of the fluid supply unit at the fluid dock (105). In any example presented herein, the printing device may determine whether the fluid is original manufacture approved fluid that is to be used in connection with the printing device. In this example, the printing device may prevent a refill if the fluid within the fluid supply unit, according to the characteristics of the fluid, may cause damage to any part of the printing device and/or produce relatively inferior printed units should the fluid be used.

In any example presented herein, the mechanical coupling of the fluid supply unit to the fluid dock (105) may include a number of guide features on the fluid dock (105) that interface with guide features of the fluid supply unit. The guide features may provide sufficient structural support to allow the fluid supply unit to be placed in a hung configuration relative to the fluid dock (105). Accordingly, the guide features may be sufficiently rigid to support a weight of the fluid supply unit as the printing device conducts the refill process unattended by the user. In a specific example, the fluid dock (105) may include a number of rails that interface with a number of guide surfaces located on the fluid supply unit.

In any example presented herein, the refill process may be relatively quicker than refill processes conducted by a user by hand. In an example, the refill process may take between half a minute to 5 minutes in order to transfer a volume of fluid equal to or more than 1 liter from the fluid supply unit to an internal reservoir of the printing device via the fluid dock (105). In an example, this refill process may take less than 2 minutes to complete. Because the fluid supply unit is hanging from the fluid dock (105) unattended by a user, the rapidity of the fluid transfer may allow for a user to focus attention on other printing devices and/or other functionalities of the printing device.

Figure 2:
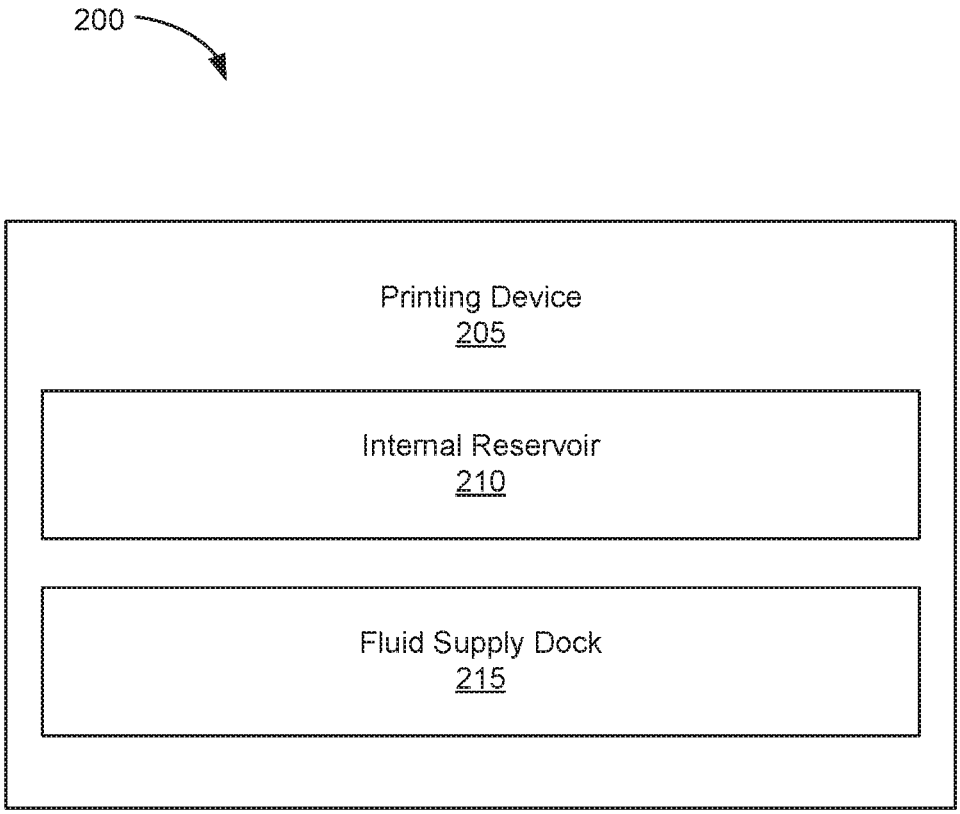
FIG. 2 is a block diagram of a continuous fluid supply system according to an example of the principles described herein.

FIG. 2 is a block diagram of a continuous fluid supply system (200) according to an example of the principles described herein. In any example presented herein, the continuous fluid supply system (200) is included in a printing device (205). In an example, the printing device (205) may include an internal reservoir (210) and fluid supply dock (215) fluidically coupled to the internal reservoir (210). The fluid supply dock (215) may be arranged to receive a fluid supply unit as described herein. Although specific examples on how the fluid supply dock (215) receives the fluid supply unit, other examples exist and the present specification contemplates the use of any other mechanical interfaces, such as those that allow the fluid supply unit to hang off of the fluid supply dock (215) unattended by a user. In these examples, the fluid supply dock (215) may support a relatively heavy fluid supply unit such as a fluid supply unit that maintains a liter or more of fluid therein.

In any example presented herein, the fluid supply dock (215) is external to a surface of a housing of the printing device. In the present specification and in the appended claims, the term "external" is meant to be understood as proximate to an external face on a printing device. In this example, the external access of the fluid supply dock (205) allows for a user to have immediate access to the fluid supply dock (215) in order to interface the fluid supply unit thereto. Additionally, this allows for a complete interfacing of the fluid supply unit to the fluid supply dock (215) using a single motion: e.g., by interfacing the fluid supply unit with the fluid supply dock (215), the fluid supply dock (215) interfaces with the fluid supply unit mechanically, fluidically, and/or electrically. In any example presented herein, by interfacing the fluid supply unit with the fluid supply dock (215), the fluid supply unit may electrically and mechanically interface with the fluid supply dock (215) prior to the fluid supply unit interfacing with the fluid supply dock (215) fluidically. However, in this example and as explained herein, the user may still cause the fluid supply unit to interface with the fluid supply dock (215) via a single motion: placing the fluid supply unit in the mechanical interface of the fluid supply dock (215).

In any example presented herein, the printing device (205) may include an internal reservoir (210). The internal reservoir (210) may be any type of fluid reservoir that may receive an amount of fluid from a fluid supply unit via the fluid supply dock (215). In any example presented herein, the internal reservoir (210) may hold an amount of fluid that exceeds that volumetric capacity of the fluid supply unit. In any example presented herein, the internal reservoir (210) may hold an amount of fluid that is equal to a volumetric capacity of the fluid supply unit. In any example presented herein, the internal reservoir (210) may hold an amount of fluid that is less than a volumetric capacity of the fluid supply unit.

In any example presented herein, the printing device (205) may include a controller. As described herein, the controller may include the hardware architecture to retrieve executable code from, for example, a data storage device associated with the printing device and execute the executable code. The executable code may, when executed by the controller, cause the controller to implement the functionality of the printing device according to the methods of the present specification described herein. In any example presented herein, the controller may execute executable or computer program code to detect the presence of the fluid supply unit at the fluid supply dock (215) and conduct an internal reservoir (210) refill operation unattended by a user.

Figure 3:
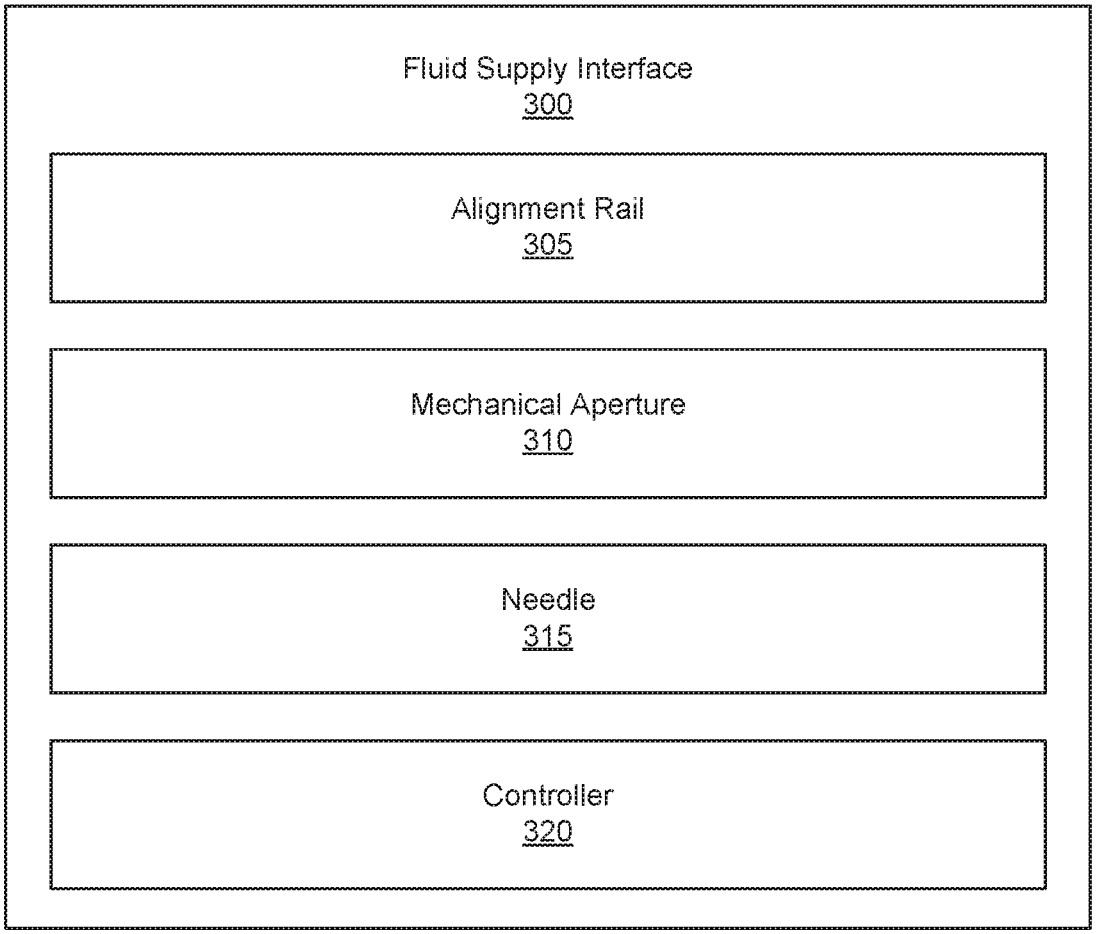
FIG. 3 is a block diagram of a fluid supply interface of a fluid supply dock according to an example of the principles described herein.

FIG. 3 is a block diagram of a fluid supply interface (300) according to an example of the principles described herein. In any example presented herein, the fluid supply interface (300) may include an alignment rail (305). The alignment rail (305) may interface with a guide surface formed on part of the fluid supply unit as described herein. This alignment rail (305) may align and position the fluid supply unit with, for example, a needle (315) and/or a mechanical aperture (310) formed on the fluid supply interface (300). Proper alignment of the fluid supply unit with either of the needle (315) or mechanical aperture (310) prevents either from being damaged during the interfacing of the fluid supply unit with the fluid supply interface (300).

The fluid supply interface (300) may include a needle (315) as described herein. In an example, the needle (315) may be sheathed behind a rigid structure of the fluid supply interface (300). In this example, the sheath may be pushed away by a surface of the fluid supply unit during interfacing of the fluid supply unit with the fluid supply interface (300). The needle (315) may be hollow so as to provide a fluidic channel spanning from a reservoir within the fluid supply unit to the fluid supply interface (300). In an example, the needle (315) may be rigid enough to interface with a number of devices within the fluid supply unit such as a valve in order to open the valve.

The fluid supply interface (300) may further include a mechanical aperture (310) to interface with a mechanical key formed on the fluid supply unit. In an example, the mechanical aperture (310) allows for the mechanical key, if sized and formed correctly, to fit within the mechanical aperture (310). As will be described herein, the mechanical key may have a specific shape that designates which out of a plurality of fluid supply interfaces (300) the fluid supply unit may be coupled to.

In any example presented herein, the fluid supply interface (300) may include a supply dock as descried herein. The supply dock may include any number of interfaces to interface with any number of fluid supply units. In this example, multiple supply docks may be arranged side-by-side to facilitate the interfacing of multiple fluid supply units with the supply docks simultaneously. In an example, the interfacing of the multiple fluid supply units with the supply docks allows for the printing device to conduct an internal reservoir refill operation for multiple types and/or colors of fluid. In an example, the supply docks may be arranged to allow the interfaced fluid supply units to sit side-by-side as they hang from the supply dock (FIG. 2, 215) unattended by the user.

In any example presented herein, the fluid supply interface (300) may be associated with a controller (320). The controller (320) may, as described herein, conduct an internal reservoir refill operation unattended by a user. The controller (320) may execute computer readable program code to cause signals to be sent to various valves, pumps, and other physical devices to, for example, conduct the internal reservoir refill operation without interaction from the user while the operation is being conducted. The controller (320) may, in any example presented herein, detect the interfacing of any fluid supply unit with the fluid supply interface (300). When detected, the fluid supply interface (300) may conduct an internal reservoir refill operation unattended by a user as described herein.

The fluid supply unit may include an interface that interfaces mechanically with the fluid supply interface (300). As described herein, the interface may connect a supply reservoir in the fluid supply unit with the fluid supply interface (300). The shape and form of the interface may mate with the fluid supply interface (300) so that the fluid supply unit may hang on the printing device unattended by the user.

Figure 4A:
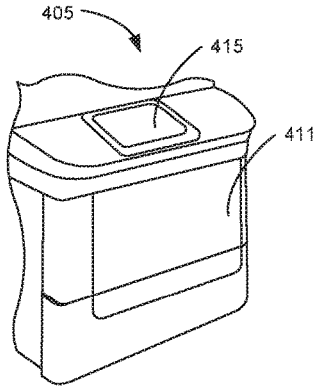
FIGS. 4A-4C are front perspective views of a supply dock of a printing device according to an example of the principles described herein.
Figure 4B:
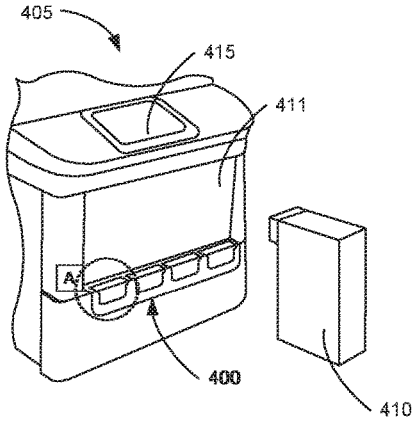
Figure 4C:
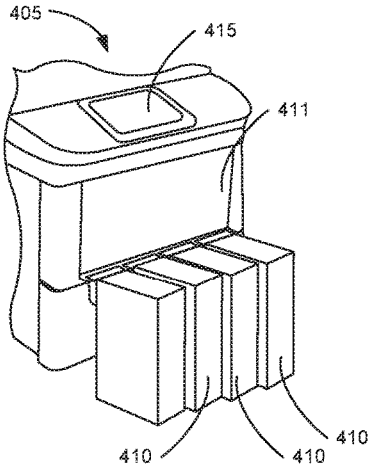

FIGS. 4A-4C are front perspective views of a supply dock (400) of a printing device (405) according to an example of the principles described herein. In any example presented herein, the supply dock (400) may include a door (411) that temporarily covers the supply dock (400) when the supply dock (400) is not in use. In other examples, the door (411) does not exist and the supply dock (400) may be exposed to the exterior of the printing device (405). In either example, the supply dock (400) allows any number of fluid supply units to hang from the supply dock (400) exterior to any housing of the printing device (405).

FIG. 4B shows a plurality of supply docks (400). In this example, FIG. 4B shows four individual supply docks (400). Although four supply docks (400) are shown in FIG. 4B, more or fewer than four supply docks (400) may be formed into the printing device (405). As an example, the four supply docks (400) may be arranged to receive, at the printing device (405), four distinct types and/or colors of printing fluid to the printing device (405). In the example where the printing device (405) is a 2D printing device, the four different supply docks (400) may receive four different colors of printing fluid such as cyan, magenta, yellow, and black (CMYK color model). In the example where the printing device (405) is a 3D printing device, the four different supply docks (400) may provide any number of types of fluid that may include any additive manufacturing liquid and/or agent, a fusing agent, an inhibitor agent, a binding agent, a coloring agent, and/or a material delivery agent.

In any example presented herein, the supply docks (400) may be populated with fluid supply units (410). As the fluid supply units (410) interface with the supply docks (400), they may hang from the supply docks (400). In an example, the fluid supply units (410) may be arranged to fit side by side on the supply docks (400). During the refill process described herein, the supply docks (400) may allow for the fluid supply units (410) to hang, unattended by the user, from off of the supply docks (400). In these examples, the supply docks (400) may be rigid enough to support a relatively heavy weight of the fluid supply units (410). In some examples, the weight of 1 liter or more of fluid maintained within each of the fluid supply units (410) may be held by the supply docks (400).

In some examples, the printing device (405) may include a user interface (415). The user interface (415) may be used by a user after any number of fluid supply units (410) have been coupled to the supply docks (400). As described herein, a controller associated with the printing device (405) may detect the presence of a fluid supply unit (410) interfaced with a supply dock (400). When this detection occurs, a user may be notified that the fluid supply unit (410) has been detected. Other notifications may be presented to the user as well including, but not limited to, a notice that the fluid maintained within the fluid supply unit (410) is acceptable for use, the amount of fluid within the fluid supply unit (410), and the authenticity of either the fluid supply unit (410) and/or fluid maintained therein, among other notifications. In an example, the user interface (415) may provide a user with the option to conduct a refill process as described herein. When a refill process is conducted, the printing device (405) may draw from each of the fluid supply units (410) an amount of fluid into one or a plurality of internal reservoirs.

Figure 5:
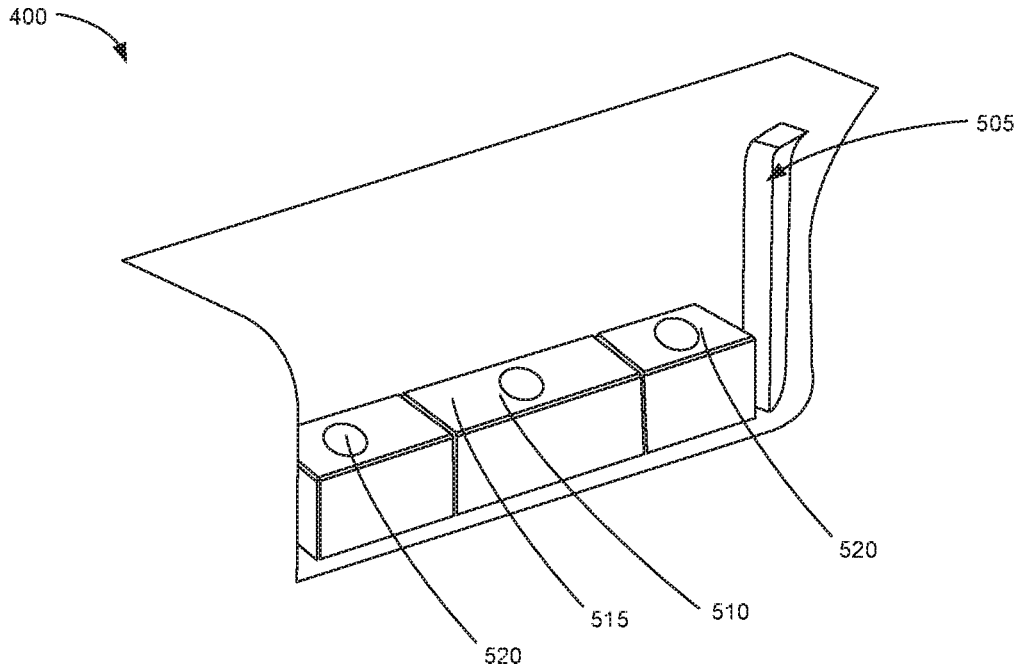
FIG. 5 is a perspective view of a supply dock shown in FIG. 4B circle A according to an example presented herein.

FIG. 5 is a perspective view of a supply dock (400) shown in FIG. 4B circle A according to an example presented herein. The supply dock (400) may include a number of rails (505) that may interface with matching guide surfaces of a fluid supply unit (FIG. 4, 410). The rails (505) may be sufficiently rigid to support the weight of the fluid supply unit (FIG. 4, 410) as the fluid supply unit (FIG. 4, 410) hangs from the supply dock (400). In an example, the rails (505) may be made of metal, plastic, or other type of resilient material.

In any example presented herein, the fluid supply unit (FIG. 4, 410) may include a port (510) to fluidically couple the fluid supply unit (FIG. 4, 410) to the supply dock (400). The port (510) may include a sheathed needle. In this example, the sheathed needle may remain sheathed until the sheath (515) is pushed away by an interface of the fluid supply unit (FIG. 4, 410). In this example, as the sheath (515) is pushed back by the interface of the fluid supply unit (FIG. 4, 410) the needle is revealed allowing it to simultaneously enter a septum of the interface of the fluid supply unit (FIG. 4, 410). Although, specific examples described herein include a needle, sheath, and septum, these are meant merely as examples and the present specification contemplates the use of any type of fluidic interface that allows fluid to pass from the fluid supply unit (FIG. 4, 410) to an internal reservoir of the printing device via the port (510) of the supply dock (400).

In any example presented herein, the supply dock (400) may further include a number of keyholes (520) to receive a number of keys formed on an interface of the fluid supply unit (FIG. 4, 410). The keyholes (520) may be specific to a specific fluid supply unit (FIG. 4, 410). By way of example, each distinct fluid supply unit (FIG. 4, 410) may include a number of keys that define the type and/or color of fluid maintained therein. As a user attempts to interface a fluid supply unit (FIG. 4, 410) with the supply dock (400), the keyholes (520) may selectively prevent or allow the interfacing of that fluid supply unit (FIG. 4, 410) based on whether the keys on the interface of the fluid supply unit (FIG. 4, 410) fit within the keyholes (520) of the supply dock (400). As described herein, although on fluid supply unit (FIG. 4, 410) with its distinct keys may not fit in any given fluid supply unit (FIG. 4, 410), it may fit and interface with a different supply dock (400). By way of example, a fluid supply unit (FIG. 4, 410) holing a specific color or type of fluid therein may be keyed to fit into and interface with a single and specific supply dock (400) that has a keyhole (520) keyed to that specific key.

Figure 6:
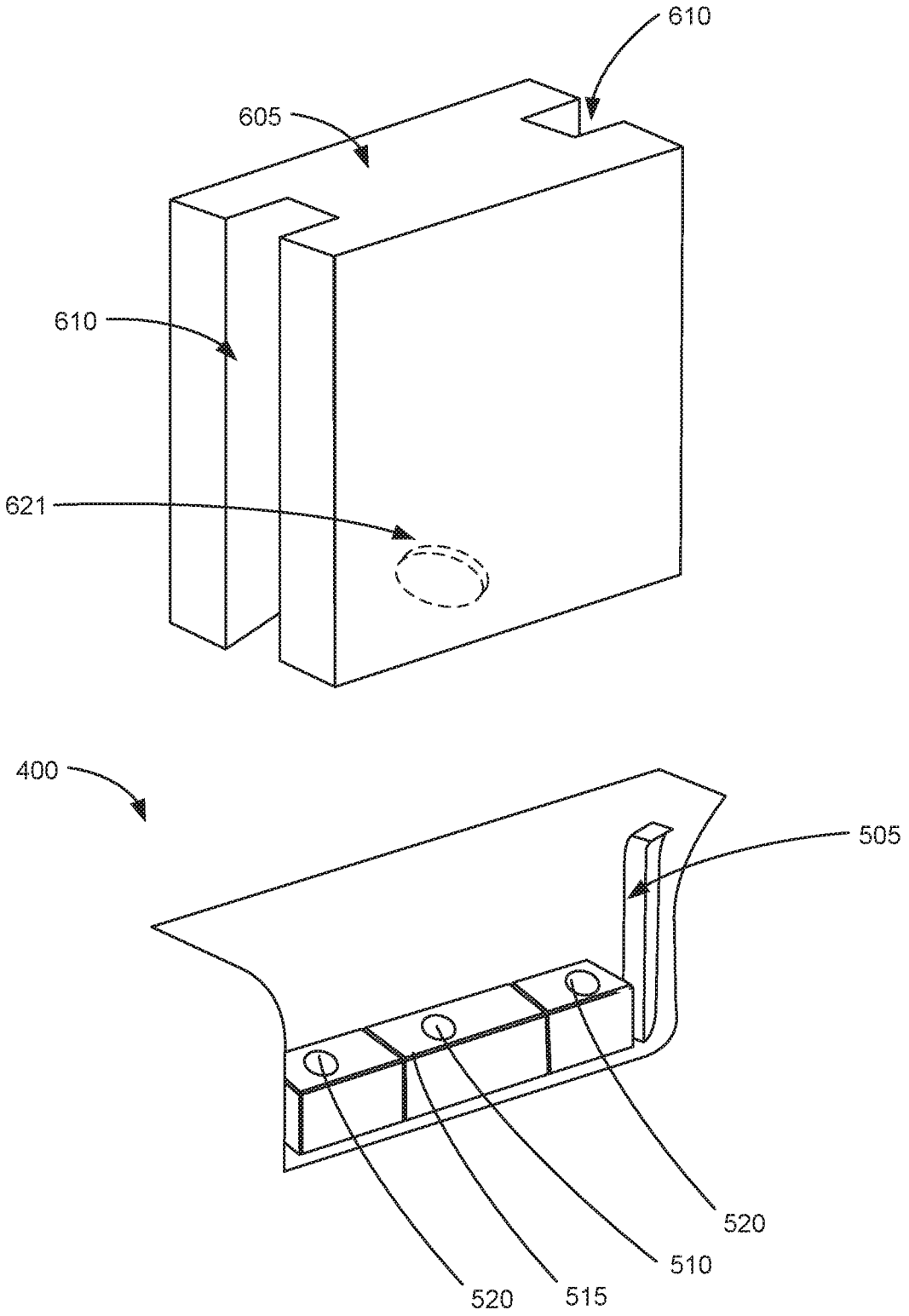
FIG. 6 is a perspective view of a supply dock shown in FIG. 4B circle A interfacing with an interface of a fluid supply unit according to an example presented herein.

FIG. 6 is a perspective view of a supply dock (400) shown in FIG. 4B circle A interfacing with an interface (605) of a fluid supply unit according to an example presented herein. As described herein, the fluid supply unit (FIG. 4, 410) may include an interface (605) that include a number of guide surfaces (610) to interface with the rails (505) of the supply dock (400). Although the figures in the present description show specific shapes of the interface (605) having specific guide surfaces (610), the present specification contemplates that the interface (605), rails (505), guide surfaces (610), and supply dock (400) may take any form that allows the fluid supply unit (FIG. 4, 410) to hang from the supply dock (400) unattended by a user.

In any example presented herein, the interface (605) of the fluid supply unit (FIG. 4, 410) may include a septum (621) to interface with a needle of the supply dock (400). The septum (621) may selectively prevent fluid maintained in the fluid supply unit (FIG. 4, 410) from exiting the fluid supply unit (FIG. 4, 410) until interfaced with the supply dock (400) described herein.

Figure 7:
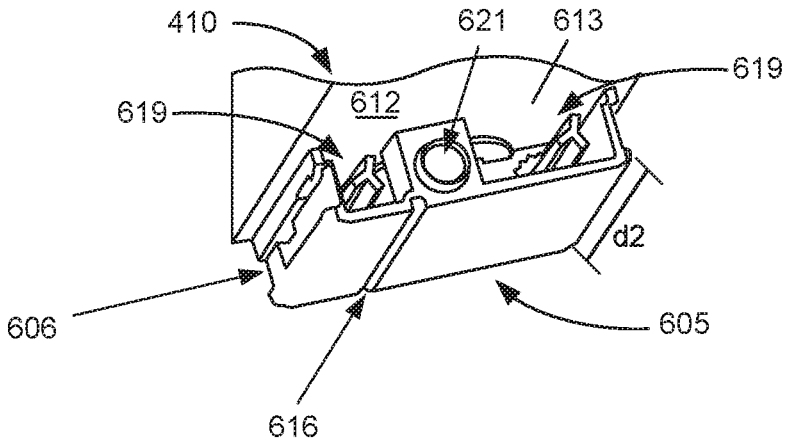
FIGS. 7 and 8 are a perspective view and front view, respectively, of an interface of a fluid supply unit according to an example of the principles described herein.
Figure 8:
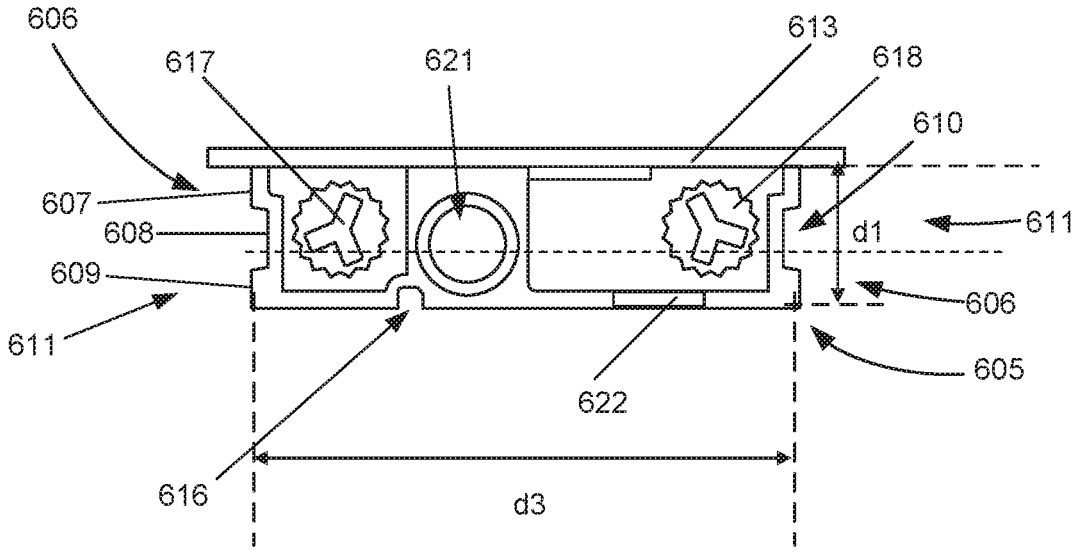

FIGS. 7 and 8 are a perspective view and front view, respectively, of an interface (605) of a fluid supply unit (FIG. 4, 410) according to an example or the principles described herein. In any example presented herein, the interface (605) may include a number of lateral guide features (606, 607). The lateral guide features (606, 607) include first lateral guide surfaces (606) and second lateral guide surfaces (607) at angles with respect each other. In this example, the first (606) and second lateral guide surfaces (607) may define a lateral guide slot (610) in a side (611) of the interface (605). The lateral guide slot (610) may be formed on both sides (611) of the interface (605). The sides (611) may include a first lateral guide surface (607) to facilitate positioning the fluid supply unit (FIG. 4, 410) with respect to a needle of the supply dock (FIG. 4, 400) in a direction parallel to a third interface dimension (d3) and/or second lateral guide surface (608) to facilitate positioning the interface (605) with respect to the needle of the supply dock (FIG. 4, 400) in a direction parallel to a first interface dimension (d1).

The first lateral guide surface (607) may extend approximately parallel to the second interface dimension (d2). The first lateral guide surfaces (607) may be substantially flat in a plane approximately parallel to the first and second interface dimension (d1, d2), wherein approximately parallel may for example include 10 degrees or less deviation from absolutely parallel. The first lateral guide surfaces (607) may be elongate along the second interface dimension (d2), that is, relatively long along the second interface dimension (d2) and relatively short along the first interface dimension (d1). Where during installation of the fluid supply unit (FIG. 4, 410) the structure of the interface (605) projects downwards from a bottom surface (612) of a box (613), the first lateral guide surface (607) may facilitate approximately horizontal positioning of the interface (605) with respect to a liquid input or needle of the supply dock (400).

In any example presented herein, a single side (611) may have a plurality of first lateral guide surfaces (607) at a plurality of levels along the third interface dimension (d3). The lateral guide slot (610) may include a third lateral guide surface (609) that is offset in an inwards direction along the third interface dimension (d3) with respect to the first lateral guide surface (607) and second lateral guide surface (608). The third lateral guide surface (609) and first and second lateral guide surfaces (607, 608) may span the first interface dimension (d1), approximately. In certain examples, the third lateral guide surface (609) without the first and second lateral guide surface (607, 608), or a single third lateral guide surface (609) and one of the first lateral guide surface (607) or second lateral guide surface (608) may be formed in the interface (605), which can be sufficient for positioning the interface (605) along the first and/or third interface dimension (d1, d3). In other examples a single third lateral guide surface (609) or first or second lateral guide surface (607, 608) may be sufficient to serve the purpose of guiding and positioning, for example together with any other intermediate guide features (616). In yet other examples, a single lateral guide feature (607, 608, 609) and intermediate guide features (616) is provided.

In any example presented herein, the interface (605) may include a first key pen (617). In any example presented herein, the interface (605) may include a second key pen (618). The interface (605) may also include a number of recesses (619) that have a depth along the container side from which the structure of the interface (605) projects. The key pens (617, 618) extend parallel to the second interface dimension (d2).

In any example presented herein, the interface (605) may include a septum (621). The septum (621) includes a breakable membrane at its center, for example downstream of an internal channel formed within the interface (605) and fluidically coupling the septum (621) to a fluid reservoir or bag within the box (612). The septum (621) may be arranged to be pierced by a needle when a needle is inserted at any time. The needle may pierce the membrane at insertion and interfacing of the interface (605) with the fluid supply dock (FIG. 4, 400). The channel and membrane may be centered around a single central axis of the interface (605). The membrane is arranged to seal the inserted needle, along said central axis. In certain examples, the interface (605), in use, may push a sheath of the fluid needle. The membrane may inhibit fluid/vapor transfer to seal the interface (605) during transport or on the shelf life of the fluid supply unit, as well as seal to the needle during needle insertion. Instead of a pierceable membrane, any suitable label or film or the like, for example for tearing, removing or piercing, may cover the internal channel at the downstream end. Similarly, a separate lid or plug could be provided, or other measures, to seal the liquid channel during transport and storage.

As shown in FIGS. 7 and 8, the interface (605) may include a number of key pens (617, 618). As described herein, the key pens (617, 618) may be formed to have any shape that may fit into receiving keyholes (FIG. 5, 520) formed on the supply dock (FIG. 4, 400). Each of these key pens (617, 618) may be arranged specifically to fit into a specific keyhole (FIG. 5, 520). As described above, the specific arrangement of the key pens (617, 618) may denote the type and/or color of fluid maintained in the fluid supply unit. Consequently, the key pens (617, 618) may prevent the interfacing of the fluid supply unit with the supply dock (FIG. 4, 400) if the key pens (617, 618) arrangement does not match. The key pens (617, 618) may also be arranged to prevent interfacing of the fluid supply unit with the supply dock (FIG. 4, 400) either partially or not at all. In an example, the rails (FIG. 5, 505) of the supply dock (FIG. 4, 400) may be allowed to mechanically interface with the lateral guide features (606, 607) but may prevent the electrical and or fluidic interfacing of the interface (605) with the supply dock (FIG. 4, 400). This may be because of the length of the key pens (617, 618) prevent the fluidic interfaces and/or electrical interfaces from being complete. As a consequence, a fluidic connection between the supply dock (FIG. 4, 400) and the interface (605) will not be completed where the fluid to be transferred from the fluid supply unit (FIG. 4, 410) to the printing device is not to be received at that specific supply dock (FIG. 4, 400). This prevents cross contamination of fluids and prevents even the needle in the supply dock (FIG. 4, 400) from being contaminated with another type and/or color of fluid.

In any example presented herein, the interface (605) may further include a memory device (622). The memory device (622) may include any type of contact pads that, when the interface (605) is coupled to the supply dock (FIG. 4, 400), create an electrical coupling of the memory device (622) and a controller of the printing device. Any arrangement of contact pads on the interface (605) and correlating contact pads on the supply dock (FIG. 4, 400) may be formed. In an example, the arrangement of the contact pads on either the supply dock (FIG. 4, 400) or the interface (605) may be such that electrical coupling does not occur until and unless the key pens (617) are fully engaged with the keyholes (FIG. 5, 520).

Figure 9:
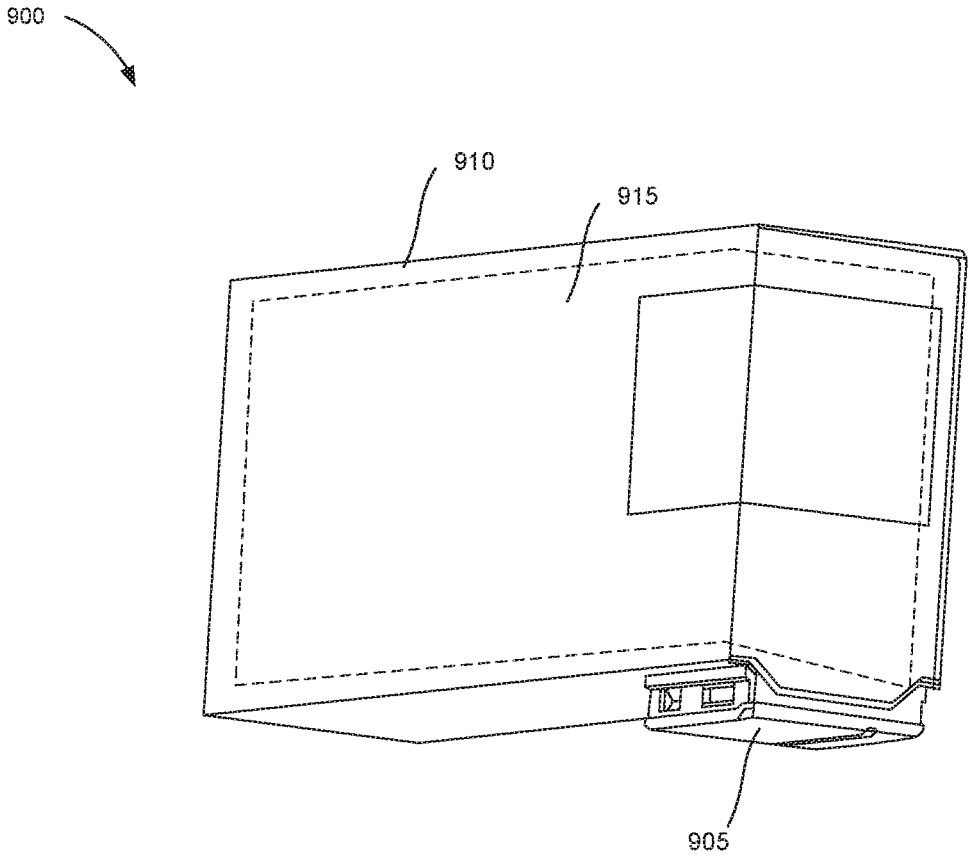
FIG. 9 is an isometric view of a fluid supply unit and its interface according to an example of the principles described herein.

FIG. 9 is an isometric view of a fluid supply unit (900) and its interface (905) according to an example of the principles described herein. In this example, the fluid supply unit (900) may be in the form of a bag-in-box fluid supply unit (900). The bag-in-box fluid supply unit (900) may include a box (910) that holds the interface (905) thereto while also providing a space therein to maintain a fluidic bag (915).

The box (910) may be a folded carton structure to support and protect the fluidic bag (915), as well as provide for descriptions, instructions, and logos, among other images to be imaged on its outside. The box (910) may provide for protection against leakage of the fluidic bag (915) such as by shocks and/or during transport. Additionally, the box (910) may prevent the fluidic bag (915) from being punctured. The box (910) can be generally cuboid, including six generally rectangular sides, defined by carton walls, whereby side from which the interface (905) projects. In an example, the box (910) may include an opening to allow liquid to flow from the fluidic bag (915) through the box (910) and to the interface (905). The opening may be provided adjacent a second side that is at approximately right angles with the first mentioned side. In some of the examples, the opening is provided in a bottom wall (first wall) near a back wall (second wall) to allow for the interface structure to project from the bottom near the back whereby the container volume may project beyond the liquid interface in a main direction of outflow of the liquid, along the main liquid flow direction. The box (910) may include, in any example presented herein, a push indication and/or strengthening member on or along the second side, e.g. the back side, to indicate to an operator to push against that side for mounting and/or unmounting the fluid supply unit (900).

The fluidic bag (915) includes a bag of flexible film walls, the walls comprising plastic film that inhibits transfer of fluids such as gas, vapor and/or liquids. In an example, multi-layered thin film plastics may be used. Thin film material may reduce the use of plastic material, and consequently, the potential environmental impact. In a further example a metal film may be included in the multiple layers. The flexible film reservoir walls may include PE, PET, EVOH, Nylon, Mylar or other materials.

In different examples, the fluidic bag (915) may facilitate holding of print fluid for example 50 ml, 90 ml, 100 ml, 200 ml, 500 ml, 700 ml, 1 L, 2 L, 3 L, 5 L or more print fluid. Between different volume containers, the same fluidic bag (915) may be partially filled to facilitate different reservoir volumes using a single fluidic bag (915).

The fluidic bag (915) may include a relatively rigid interconnect element more rigid than the rest of the flexible fluidic bag (915), for fluidic connection to the interface (905), allowing the fluid in the fluidic bag (915) to flow to the receiving station. In an example, the interconnect element may include flanges to facilitate attachment to the respective support structure wall at the edge of the opening. The fluidic bag (915) may be arranged to contain approximately 0.1, 0.2, 0.5, 0.7, 1, 2, 5 or more liters of liquid. The interconnect element may connect to the fluidic bag (915) connecting portion of the liquid channel of the interface structure, for example to a protruding cylindrical connector component of the reservoir connecting portion. In an example, most of the fluidic bag (915) inside the box (910) will project away in the main liquid output direction for supplying the liquid, for example more than 60, 70, 80, or 90% of the second dimension (d2) of the substantially filled reservoir projects away from the interface (605).

Figure 10:
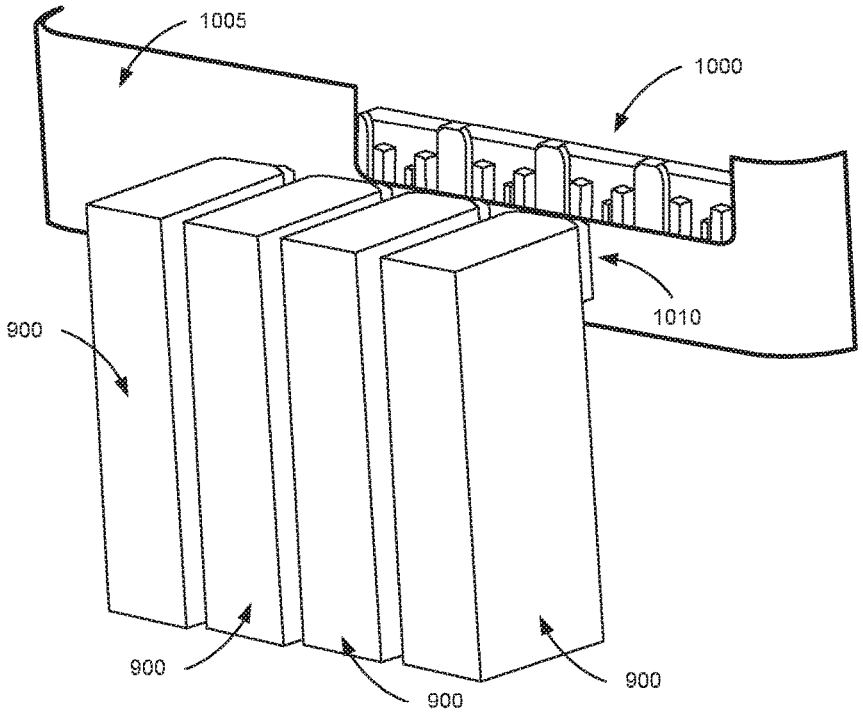
FIG. 10 is a perspective view of a plurality of fluid supply units and a supply dock of a printing device according to an example of the principles described herein.

FIG. 10 is a perspective view of a plurality of fluid supply units (900) and a supply dock (1000) of a printing device (1005) according to an example of the principles described herein. In the example shown in FIG. 10, four fluid supply units (900) are shown in a state of not being interfaced with any of the supply docks (1000) formed on the printing device (1005). The individual fluid supply units (900) may be set to hang, by their respective interfaces (1010), from off of the individual supply docks (1000).

Figure 11:
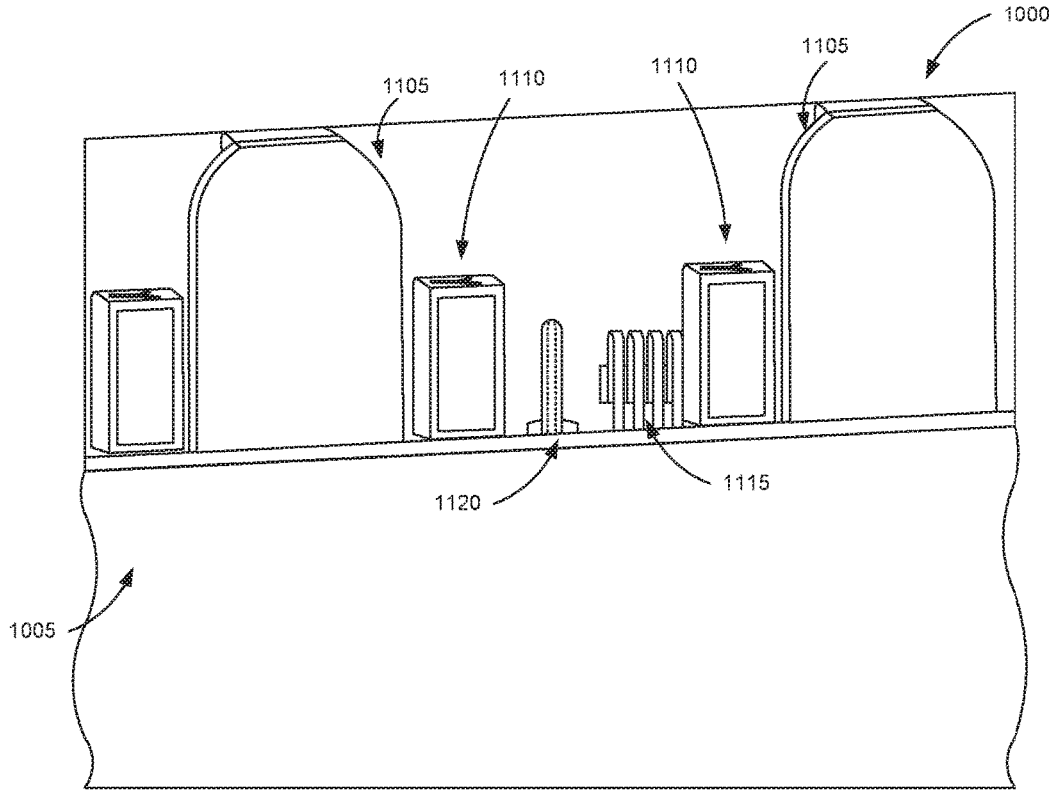
FIG. 11 is a perspective view of a supply dock (1000) shown in FIG. 10 according to an example of the principles described herein.

FIG. 11 is a perspective view of a supply dock (1000) shown in FIG. 10 according to an example of the principles described herein. The supply dock (1000) associated with any single given fluid supply unit (FIG. 9, 900) may include a number of rails (1105). The rails (1105), as described herein, may interface with a guide surface (FIG. 6, 610) of an interface (1010) so as to mechanically support the fluid supply units (900) on the supply dock (1000). Any number of rails and guide surfaces (FIG. 6, 610) may be used and the present specification contemplates such use in order to both align and secure the fluid supply units (900) to the supply dock (1000).

The supply dock (1000) may further include a number of keyholes (1110). The keyholes (1110) each include a recess that may receive a key pen (FIG. 6, 617, 618) as described herein. Again, the arrangement of the key pen (FIG. 6, 617, 618) relative to the keyholes (1110) allows or prevents any given fluid supply units (900) from interfacing with the supply dock (1000) either mechanically, electrically, or fluidically. In an example where any given key pen (FIG. 6, 617, 618) is not arranged to interface with the keyholes (1110) mechanically, the length of the keyholes (1110) and/or key pens (FIG. 6, 617, 618) prevent the fluidic coupling of the fluid supply units (900) with the printing device (1005).

The fluid supply units (900) may interface electrically with the supply dock (1000) via a number of electrical contacts (1115) formed from out of the supply dock (1000) of the printing device (1005). These electrical contacts (1115) may be flush with an interior surface of the supply dock (1000) so that they may not be accidentally or deliberately bent or otherwise damaged during use of the printing device (1005). Any number of contacts may be formed so that contact pads associated with a memory device (FIG. 8, 622) may correctly contact the electrical contacts (1115) when the fluid supply unit (900) is interfaced with the supply dock (1000).

The fluid supply units (900) may also be fluidically coupled to the supply dock (1000) via a sheathed needle (1120). As described herein, a portion of the interface (1010) of the fluid supply units (900) may push the sheath of the sheathed needle (1120) down thereby exposing the needle and allowing the needle to penetrate a septum (FIG. 6, 621) of the interface (1010). When the needle penetrates the septum (FIG. 6, 621), a fluidic connection between a number of fluidic channels formed within the interface (1010) and an internal reservoir of the printing device (1005) may be realized.

During use, a user may dock or otherwise interface multiple fluid supply units (900) to the supply dock (1000) that maintain distinct types and/or colors of fluids as described herein. The form of the interfaces (1010) allow for the boxes (FIG. 9, 910) of the fluid supply units (900) to be held close to the housing of the printing device (1005) during the refill process described herein. This prevents the fluid supply units (900) from becoming dislodged from the supply dock (1000) and printing device (1005) during the process thereby allowing for quick and efficient transfer of fluid from the fluid supply units (900) to an internal reservoir of the printing device (1005). The arrangement of the plurality of supply docks (1000) allows for multiple fluid supply units (900) to be attached and multiple refilling processes to be conducted simultaneously. Additionally, this refill process may be conducted without attention from a user. Specifically, a user does not hold the fluid supply units (900) during the process and instead the fluid supply units (900) are allowed to hang from the robust supply docks (1000) and their structures as described herein. Consequently, a user may walk away from the printing device (1005) assured that the refill process will continue automatically. The user may then address other printing devices (1005), for example, within a complex, and return later to remove the fluid supply units (900). In an example, the user may also conduct a printing process with the printing device (1005) while the herein-descried refill process is being conducted. In this example, the fluid supply units (900) may be used to "top-off" or resupply a relatively larger reservoir than the fluidic bags (FIG. 9, 915) of the fluid supply units (900). Still further, should the user be a printing device supplier or mechanic, they may address any other maintenance issues associated with the printing device (1005) while the refill process is being conducted.

Figure 12:
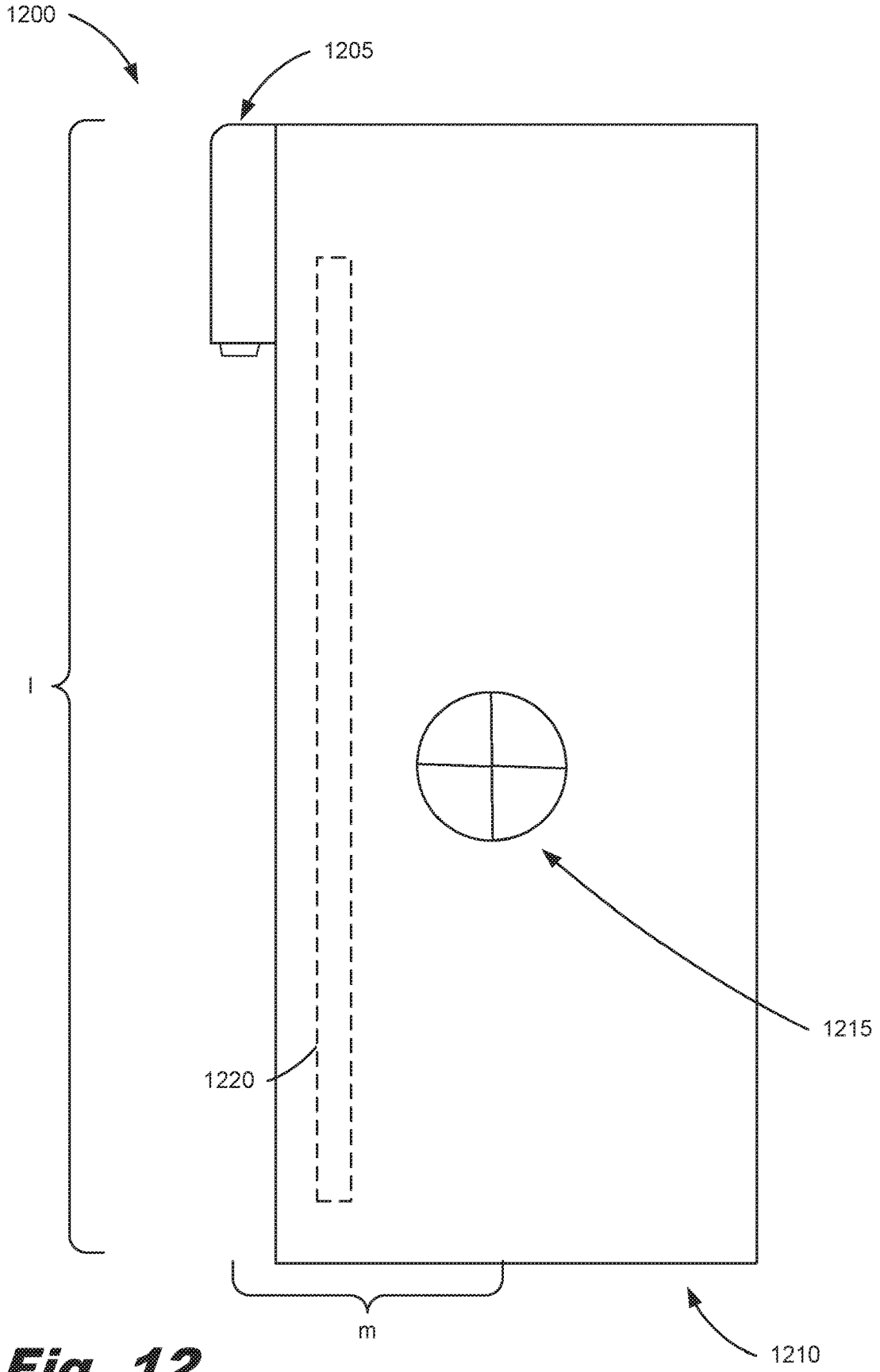
FIGS. 12 and 13 are side views of a fluid supply unit according to an example of the principles described herein.
Figure 13:
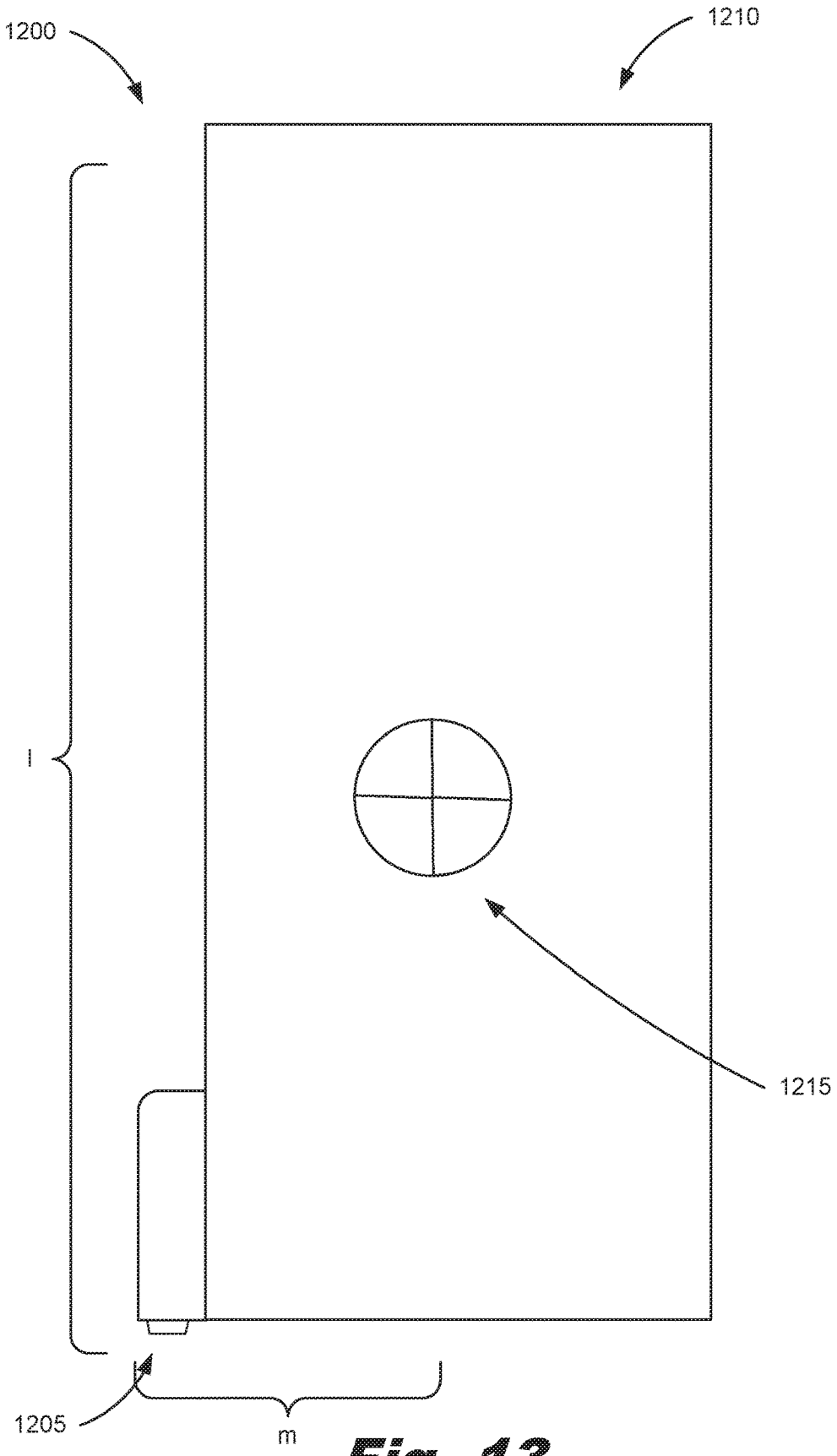

As described herein, the fluid supply unit (FIG. 9, 900) may be hung from the supply dock (FIG. 4, 400). An example of the hanging of the fluid supply units (FIG. 9, 900) from the supply docks (FIG. 4, 400) is shown in FIGS. 12 and 13. FIGS. 12 and 13 are side views of a fluid supply unit (1200) according to an example of the principles described herein. Similar to other examples presented herein, the fluid supply unit (1200) may include an interface (1205) similar to that described in connection with FIG. 10. The interface may include a septum (FIG. 6, 621) to interface with a needle of the supply dock (FIG. 4, 400) as well as a number of channels to fluidically couple the septum (FIG. 6, 621) to a fluidic bag (FIG. 9, 915) maintained in the box (FIG. 9, 910) as described herein, FIGS. 12 and 13 shows two distinct orientations of the interface (1205) relative to the box (FIG. 9, 910). These two orientations of the interface (1205) allow for two different orientations of the fluid supply unit (1200) as it hangs off of the supply dock (FIG. 4, 400) as described herein.

FIG. 12 shows an orientation of the interface (1205) relative to the box (FIG. 9, 910) where the septum (FIG. 6, 621) is directed towards a length (l) of the box (FIG. 9, 910) and towards a distal side (1210) of the box (FIG. 9, 910). In this example, the user may fluidically, mechanically, and/or electrically couple the interface (1205) to a supply dock (FIG. 4, 400) by orientating the fluid supply unit (1200) as shown in FIG. 12 and passing the rails (FIG. 5, 505) through the guide surfaces (FIG. 6, 610) of the interface (1205). After this alignment, the interface (1205) may simultaneously or subsequently be interfaced fluidically and/or electrically with the supply dock (FIG. 4, 400).

The orientation of the box (FIG. 9, 910) relative to the interface (1205) as shown in FIG. 12 allows the center of mass (1215) that is below the interface (1205) and supply dock (FIG. 4, 400). The distance between the interface (1205)/supply dock (FIG. 4, 400) (as the fluid supply unit (1200) is coupled to the supply dock (FIG. 4, 400)) and the center of mass (1215) is between 30 and 70 mm away from the printing device. In an example, the center of mass (1215) is between 20 to 40 mm across the narrow axis of the fluid supply unit (1200). In an example, the center of mass (1215) is between 85 to 145 mm across the long axis of the fluid supply unit (1200). This distance between the center of mass (1215) and the printing device allows for the center of mass (1215) to help maintain the fluid supply unit (1200) against a surface of the printing device as it is installed at the supply dock (FIG. 4, 400) due to a relatively small moment of inertia (m). Additionally, the weight of the fluid within the fluid supply unit (1200) may help to overcome any resistive forces against the fluid supply unit (1200) at the interface (1205) applied by, for example, a spring used to force the sheath of the sheathed needle (FIG. 11, 1120) upwards.

In the example shown in FIG. 12, the fluid supply unit (1200) may include a dip strip (1220) to help drawn an amount of fluid from a bottom portion of the fluidic bags (FIG. 9, 915) of the fluid supply units (900). A pump associated with the printing device may draw an amount of fluid out of the fluid supply unit (1200) using the sheathed needle (FIG. 11, 1120) and the dip strip (1220).

FIG. 13 shows the fluid supply unit (1200) with the interface (1205) flipped the opposite way as that described in connection with FIG. 12. In this example, the septum (FIG. 6, 621) of the interface (1205) is directed away from the distal side (1210) of the box (FIG. 9, 910) so that the septum (FIG. 6, 621) of the interface (1205) faces away from the distal side (1210) of the box (FIG. 9, 910). In this example, a dip strip (1220) may not be used in connection with a pump and instead gravity is allowed to provide the fluidic pressure that allows the fluid in the fluidic bag to pass through the sheathed needle (FIG. 11, 1120) and into the internal reservoir of the printing device. In an example, a pump may be used in order to provide a closed loop control of fluid extraction into the printing device. In an example, the weight of the fluid within the fluid supply unit (1200) may maintain an electrical, mechanical, and/or fluidic coupling between the fluid supply unit (1200) and the printing device.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing device interface to receive a fluid supply, the interface comprising:

a fluid dock arranged on an external surface of a housing of a printing device, the fluid dock further arranged to receive a mechanical interface of a fluid supply;

wherein the arrangement of the fluid dock on the external surface of the housing retains the fluid supply with a center of mass of the fluid supply external to the printing device, where a weight of the fluid supply helps to maintain a mechanical, fluidic, and electrical connection with the fluid dock.

2. The interface of claim 1, wherein the center of mass of the fluid supply is above the mechanical interface and wherein a fluid is transferred from the fluid supply through the fluid dock via gravity.

3. The interface of claim 1, wherein the center of mass of the fluid supply is below a fluid interface between the fluid dock and fluid supply and wherein a fluid is transferred from the fluid supply through the fluid dock via a pump downstream of the fluid dock.

4. The interface of claim 1, wherein the fluid supply comprises a bag upstream of the mechanical interface and a vertical fluid extractor to extract fluid from a lower-most portion of the bag.

5. The interface of claim 1, wherein the dock provides a fluidic channel with the fluid supply and wherein the fluid channel is created after verification via an electrical handshake that the fluid to be transferred is allowed.

6. The interface of claim 1, wherein the interface provides for a continuous transfer of fluid from the fluid supply, through the fluid dock, into an internal reservoir within the printing device during a printing operation, wherein the internal reservoir is connected to, in turn, provide fluid to a printhead of the printing device.

7. The interface of claim 1, wherein the fluid dock supports the mechanical interface of the fluid supply while the fluid supply hangs, unsupported from below, from the fluid dock.

8. The interface of claim 1, wherein the fluid dock spaces the center of mass of the fluid supply between 30 and 70 mm away from the printing device.

9. A continuous fluid supply system, comprising:

a printing device comprising:

an internal reservoir to maintain an amount of printing fluid;

a fluid supply dock external to a housing of the printing device, the fluid supply dock to receive and interface with a fluid supply unit, wherein an arrangement of the fluid supply dock external to the housing enables a center of mass and weight of the fluid supply to be used to maintain a mechanical, fluidic, and electrical connection between the fluid supply dock and the fluid supply, the center of mass of the fluid supply being outside the printing device.

10. The continuous fluid supply system of claim 9, wherein the center of mass of the fluid supply unit is above the mechanical interface and wherein a fluid is transferred from the fluid supply through the fluid dock via gravity.

11. The continuous fluid supply system of claim 9, wherein the center of mass of the fluid supply is below a fluid interface between the fluid supply dock and fluid supply unit and wherein a fluid is transferred from the fluid supply through the fluid dock via a pump downstream of the fluid dock.

12. The continuous fluid supply system of claim 9, wherein the mechanical, fluidic, and electrical connection with the fluid supply dock is achieved when the mechanical interface is fully coupled to the fluid supply dock.

13. The continuous fluid supply system of claim 12, wherein the mechanical connection with the fluid supply dock is engaged previous to a fluidic connection being engaged.

14. The continuous fluid supply system of claim 13, wherein the mechanical connection is keyed to a fluid maintained within the fluid supply unit.

15. The continuous fluid supply system of claim 9, further comprising the fluid supply unit, wherein the fluid supply unit has an elongated shape with a fluid interface being disposed at one end of the elongated fluid supply unit and facing toward an opposite end of the fluid supply unit.

16. The continuous fluid supply system of claim 9, further comprising the fluid supply unit, wherein the fluid supply unit has an elongated shape with a fluid interface being disposed at one end of the elongated fluid supply unit and facing outward away from the fluid supply unit.

17. A fluid supply interface of a fluid supply dock, comprising:

an alignment rail to mechanically couple a fluid supply unit to a fluid supply dock external to a housing of a printing device, the fluid supply unit to hang from the fluid supply interface, unsupported from below;

a mechanical aperture to interface with a mechanical key of the fluid supply unit;

a needle to fluidically couple the fluid supply unit to an internal reservoir of the printing device; and a controller to enable an electrical coupling between the printing device and a memory device;

wherein a mechanical coupling using the alignment rail is to occur prior to a fluidic coupling between the septum and the fluid supply unit.

18. The fluid supply interface of claim 17, wherein the mechanical key prevents a needle of the fluid supply unit from being fluidically coupled to the printing device until the mechanical key has interfaced with the aperture of the fluid supply dock.

19. The fluid supply interface of claim 17, wherein the alignment rail supports the weight of the fluid supply unit during a transfer of fluid from the fluid supply unit to the internal reservoir of the printing device.

20. The fluid supply interface of claim 17, wherein the fluid supply dock spaces a center of mass of the fluid supply between 30 and 70 mm away from the printing device.

* * * * *